United States Patent [19]

Sanford

[11] 4,237,786

[45] Dec. 9, 1980

[54] SPLIT-SHELL MAGNETIC CYLINDER

[75] Inventor: Homer H. Sanford, Streamwood, Ill.

[73] Assignee: Bunting Magnetics Company, Newton, Kans.

[21] Appl. No.: 951,471

[22] Filed: Oct. 16, 1978

[51] Int. Cl.[3] ..... B41F 27/02; B41F 27/06; B41L 29/02; B41L 29/06

[52] U.S. Cl. ..... 101/378; 101/382 MV

[58] Field of Search ..... 101/382 MV, 378, 415.1; 248/206 A; 269/8; 335/288, 297, 302, 306; 29/130, 129, 124, 123, 148.4 R, 148.4 D

[56] References Cited

U.S. PATENT DOCUMENTS

| | | | |
|---|---|---|---|
| 3,097,598 | 7/1963 | Hotop et al. | 101/382 MV |
| 3,897,292 | 7/1975 | Fukuyama | 101/382 MV X |
| 3,919,937 | 11/1975 | Kostal | 101/378 |

*Primary Examiner*—J. Reed Fisher

*Attorney, Agent, or Firm*—Emrich, Root, Lee, Brown & Hill

[57] ABSTRACT

A split-shell magnetic printing cylinder is made from first and second half cylinders which are joined along a plane through the axis of the cylinder. Each half cylinder or "split-shell" has first and second similar end plates with laminations stacked between the end plates. The laminations alternately form pole pieces and spacers which hold permanent magnets in contact with adjacent pole pieces. A plurality of core bars extend between and are secured to the end plates, and they are located to engage an inner curved edge of the laminations when the laminations are assembled to the core. The core bars are welded to the inner edges of the laminations for holding the laminations firmly in place. The rods extending through the laminations may also be secured to the end plates to hold the laminations. The inner edges of the laminations, the core bars and the welds are all embedded in a layer of resin such as epoxy. The split cylinders are secured together with shoulder bolts securing the end plates together.

10 Claims, 8 Drawing Figures

SPLIT-SHELL MAGNETIC CYLINDER

BACKGROUND AND SUMMARY

The present invention relates to improvements in split-shell magnetic printing cylinders. Magnetic cylinders of the type with which the present invention is concerned are used in the printing industry to hold printing forms in place. The forms are provided on a curved ferrous plate or base which is held to the cylinder through magnetic attraction. The printing surface of the form is linked, and the image is transferred to a passing web or sheet in a conventional manner.

Magnetic printing cylinders have been known for some time. The cylinders have been formed by placing laminations on a machined core. The laminations are arranged so as to alternately form pole pieces and spacers. Two or more laminations of non-ferromagnetic material may form the spacers, and apertures are provided for holding permanent magnet pieces which engage alternate pole pieces.

For convenience of fabrication and assembly to a shaft, the cylinders are provided in complementary half-cylinders or "split-shells" as they are referred to in the industry. To facilitate fabrication of the laminations to the core, the pole pieces and spacers are formed from annular plates which are then split along a diameter so that each lamination has an outer curved edge and an inner curved edge. The outer curved edge conforms to the outer surface of the cylinder on which the printing form is placed, and the inner curved edge is shaped to conform to a core on which the laminations are placed.

In the past, a core has been formed by machining a recess for the laminations from steel stock having a much larger diameter than is necessary to receive the laminations, thereby leaving a first end plate for securing the laminations by means of tie rods. Thus, after machining, an integral core piece remains comprising an end plate and a central column or hub in the form of a half cylinder on which the laminations were placed. To complete the assembly, a second end plate was welded to the distal end of the hub and the end plates and laminations were secured together by tie rods extending through the end plates and laminations parallel to the axis of the cylinder. The two split shells were then assembled to a shaft by machined dowel pins placed in the end plates having their axes perpendicular to the axis of the cylinder, and the end plates were then secured together by threaded fasteners. The principal disadvantages of this construction are the expense and time involved in machining the core and forming the integral end plate and core, and in the necessity of having to stock the separate end plates and integral end plates and cores from which the cylinders can be made. For very large sizes, cores have been fabricated from separate end plates welded to the ends of a tube forming a core. This also required machining to align the parts along the axis of the cylinder. Neither of these constructions permitted welding the laminations to the core except on the parting line of the core.

According to the present invention, first and second interchangeable end plates are used. These end plates are joined together by a plurality of core bars. Preferably, the core bars are rods having circular cross section; and their axes are parallel to and approximately equidistant from the axis of the cylinder. The core bars are located to engage the inner curved edge of the laminations when the laminations are assembled to the core.

The spacing of the core bars permits greater access to the inner edges of the laminations; and the location of the core bars in engagement with the inner edges of the laminations provides a better means of securing the laminations to the core than was possible in prior commercial constructions. The core bars are welded to the inner edges of the laminations for holding the laminations firmly in place. Tie rods extending through the laminations are also secured to the end plates to hold the laminations. Both the tie rods and the core bars have their ends threaded, in a preferred embodiment, and are secured to the end plates by nuts which are counter sunk into the outer surfaces of the end plates.

The inner edges of the laminations, the core bars and the welds are all embedded in a layer of epoxy resin which serves to further strengthen the assembly and forms a part of the core. The split cylinders are secured together with shoulder bolts received in aligned, machined bores extending through abutting end plates. Thus, the shoulder bolts perform the dual function of aligning the end plates and securing the split cylinders together.

The present invention thus obviates the need of machining a special core from a large piece of steel stock or of fabricating a weldment to form the core, while providing a better means of securing the laminations. Further, for a given size printing cylinder, the end plates are interchangeable, thereby reducing the inventory of parts that must be stocked for manufacture.

Other features and advantages of the present invention will be apparent from the following description of a preferred embodiment accompanied by the attached drawing wherein identical reference numerals will refer to like parts in the various views.

THE DRAWING

DETAILED DESCRIPTION

Figure 1:
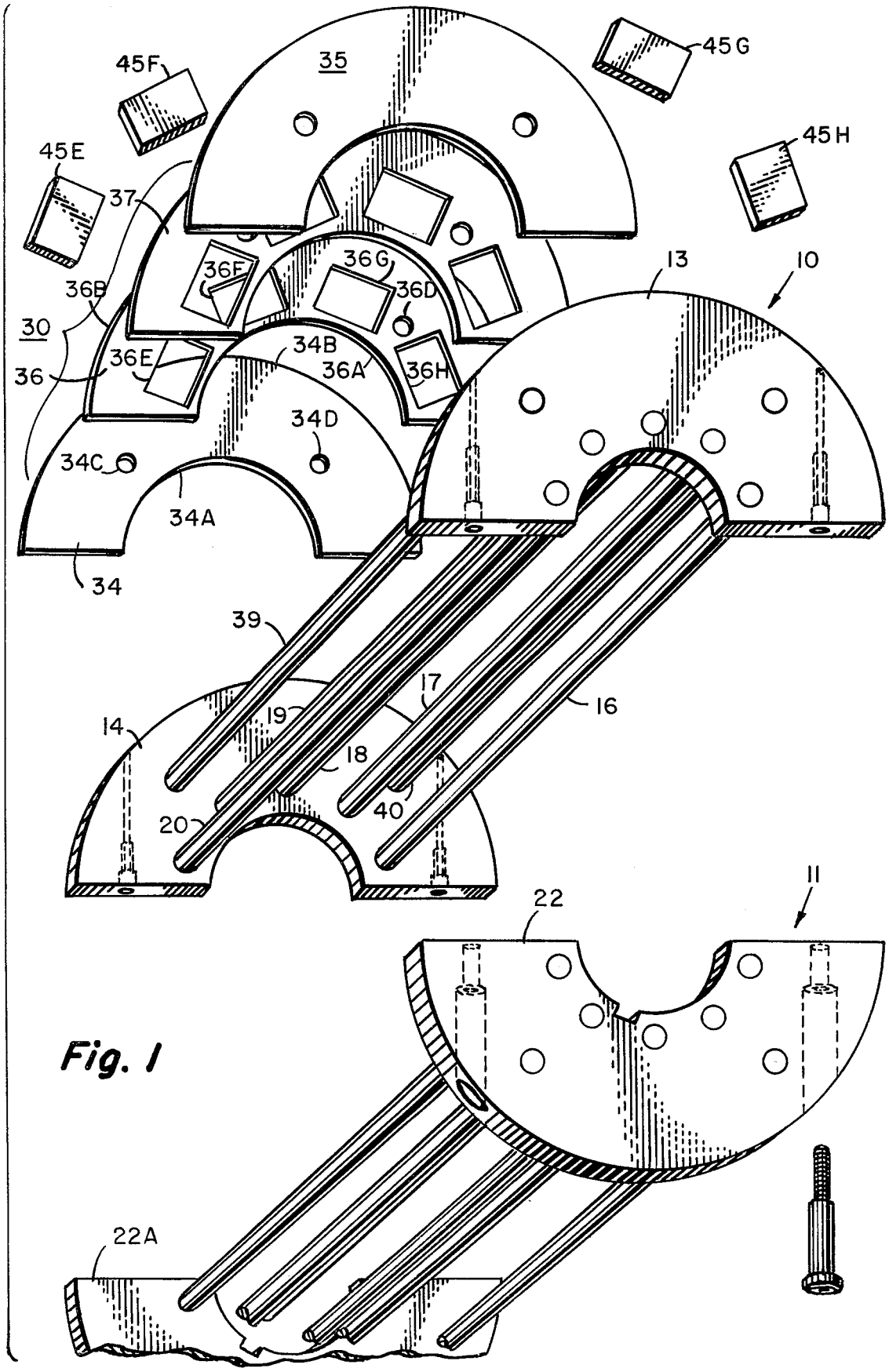
FIG. 1 is an exploded perspective view of a cylinder constructed according to the present invention.

Referring first to FIG. 1, first and second split shells are generally designated by reference numerals 10 and 11 respectively. When the split shells are secured together, in a manner to be described in more detail below, they form a magnetic printing cylinder, as will be clear to persons skilled in this art. Each of the split shells 10, 11 are similar in structure, so that only the upper split shell need be described in further detail for a complete understanding of the invention.

Turning then to the split shell 10, it includes first and second end plates 13, 14 which are secured together by a fabricated core comprising five core bars designated respectively 16, 17, 18, 19 and 20. Each of the core bars 16–20, in the illustrated embodiment is in the form of a rod having a circular cross section; and the axes of these core bars are parallel to and approximately equidistant from the axis of the finished cylinder.

Each of the end plates 13, 14 is similar in shape, and it is considered an important advantage of the present invention that for the same size cylinders, these end plates are interchangeable. Preferably, the end plate 13 for one split shell and a complementary end plate 22 for the other split shell are formed from the sample piece of stock which is split along a diameter, such as that indicated by the horizontal line 24 in FIGS. 2 and 7.

Returning to FIG. 1, a plurality of laminations generally designated 30 are received on the core bars 16–20 between the end plates 13, 14. Each of the laminations is in the form of a split annulus, having an inner curved edge for engaging the core bars, and an outer curved edge conforming generally to the outer edges of the end plates.

The laminations 30 are of two types—pole pieces 34, 35 and spacers 36, 37. Each of the spacers and pole pieces are also similar. Referring to the pole piece 34, its inner curved edge is designated 34A and its outer curved edge is designated 34B. First and second holes 34C, 34D are formed for receiving tie rods 39, 40 which are also secured to the end plates 13, 14, as will be described. Pole piece 34 is made of soft iron or other magnetizable material. The spacer 36 also has an inner curved edge 36A, an outer curved edge 36B, and a pair of holes, one of which is shown at 36D for receiving the tie rods 39, 40. In addition, four rectangular apertures 36E–36H are stamped into the spacer 36. Similar apertures are stamped into the adjacent spacer 37, and the rectangular apertures of each spacer are in register for receiving rectangular permanent magnets designated respectively 45E–45H.

Figure 4:
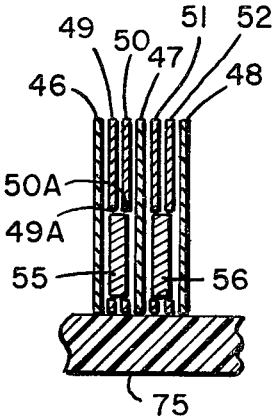
FIGS. 4 and 5 are fragmentary cross sectional views showing the relationship of the spacers and pole pieces relative to the core, with FIG. 5 being taken through the sight line 5—5 of FIG. 3.
Figure 5:
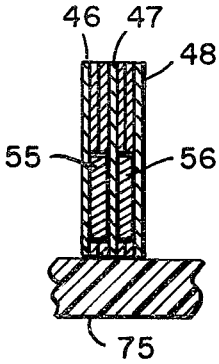
Figure 6:
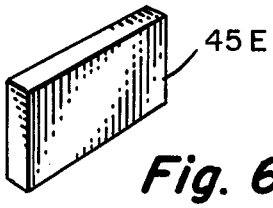
FIG. 6 is a perspective view of a permanent magnet held by the spacers.

Referring now to FIGS. 4–6, three pole pieces are designated 46, 47 and 48 respectively. Between the pole pieces 46 an 47 there are two spacers designated 49, 50; and between the pole pieces 47, 48 there are two more spacers 51, 52. Each of the spacers 49, 50 includes a plurality of apertures two of which are designated respectively 49A and 50A; and these apertures are of the same size and in register with each so as to cooperate in holding a permanent magnet 55 between the pole pieces 46, 47. When the laminations are assembled and compressed, they assume the relationship shown in FIG. 5, and the outer surfaces of the permanent magnets are in intimate contact with adjacent pole pieces. All of the magnets held by one pair of spacers are located with their poles in the same orientation; but the magnets for the adjacent pair of spacers have their poles facing a reverse orientation. Thus, referring to FIG. 5, if the north pole of the magnet 55 engages the pole piece 47, then the north pole of the magnet 56 will also engage the pole piece 47. The pole pieces act as low reluctance paths for coupling the magnetic field from the permanent magnets to the surface of the cylinder for holding the printing forms described above.

Figure 2:
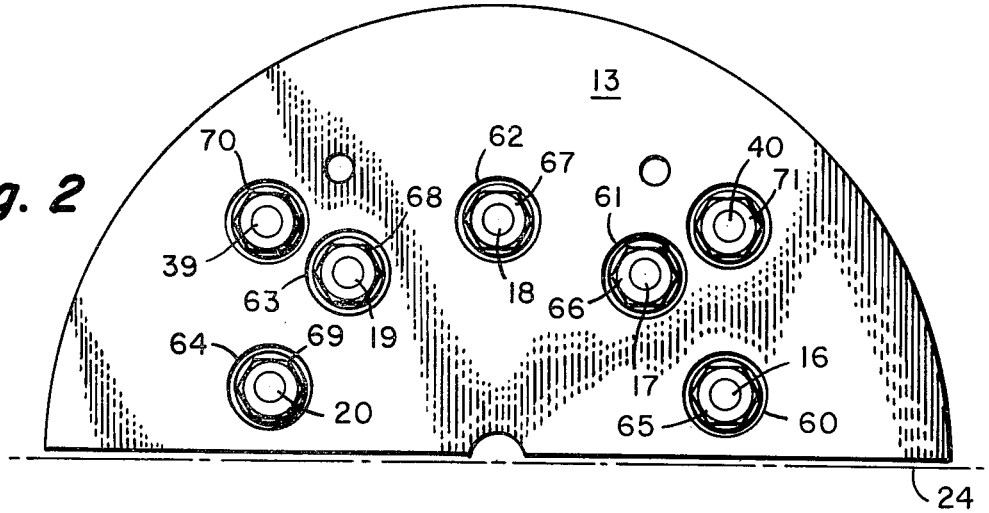
FIG. 2 is an end view of a half cylinder after assembly of the core.
Figure 3:
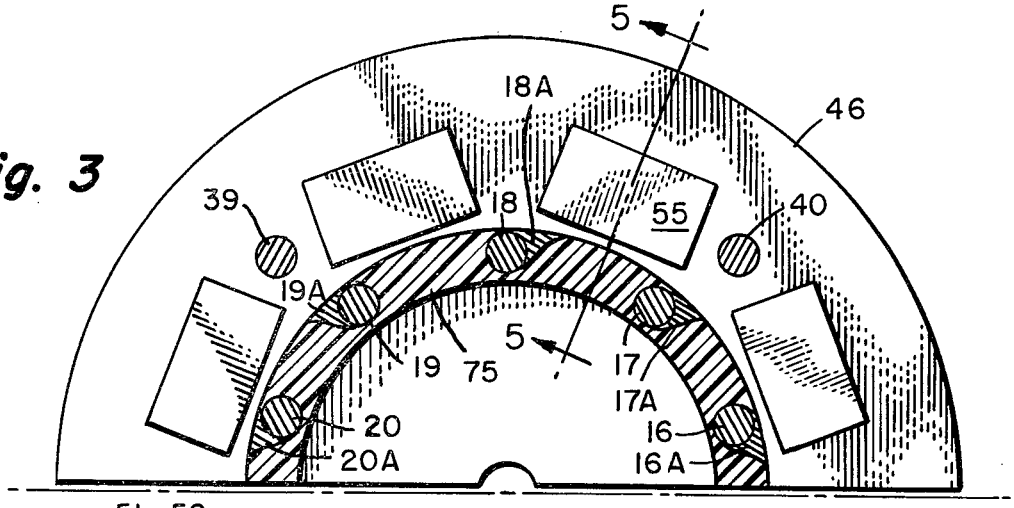
FIG. 3 is a cross sectional view of an assembled split cylinder.

Referring now to FIGS. 2 and 3, the core bars 16–20 are assembled to the end plate 13 as follows. A plurality of apertures having a diameter only slightly greater than the diameter of the rods so as to snugly receive the rods are formed in the end plate 13. The ends of the rods are threaded to extend into counter bores 60, 61, 62, 63 and 64 formed in the outer surface of the end plate; and nuts 65–69 are threaded respectively onto the threaded ends of the core bars and received into the counter bores just mentioned. The other ends of the core bars are similarly secured to the other end plate 14. The strength of the core will be enhanced if at least a portion of the smooth end of each rod (adjacent the thread portion) is snugly received into an associated bore in each end plate so as to enhance the ability of each core bar to resist bending. The tie rods 39, 40 extend through the laminations and are similarly secured to the end plate 13 by means of nuts 70, 71.

Referring now particularly to FIG. 3, after the laminations are assembled on the core bars 16–20 and the core bars and tie rods are secured as described above to the end plates, the core bars are welded to the laminations. It will be appreciated from a study of FIGS. 1 and 3 that the present construction provides access to make these welds to reduce any tendency of the laminations to move; whereas these welds would be impossible with the solid core of prior constructions. The weld joints preferably extend the entire length of the associate core bar which engages the laminations, and these weld joints are designated respectively 16A–20A. In this manner, a rigid core is formed through the cooperation of the core bars, the laminations and the weld joints. To further strengthen the core, a layer of resin such as epoxy, designated 75 is formed to cover the inner curved edges of the laminations, the core bars and the weld joints. The epoxy adheres to the inner edges of the laminations and the weld joints and the core bars to add strength and rigidity to the core, as well as to cover the exposed surfaces of these components. When the tie rods and core bars are assembled to the end plates, the laminations are under compression to further add rigidity to the structure.

Figure 7:
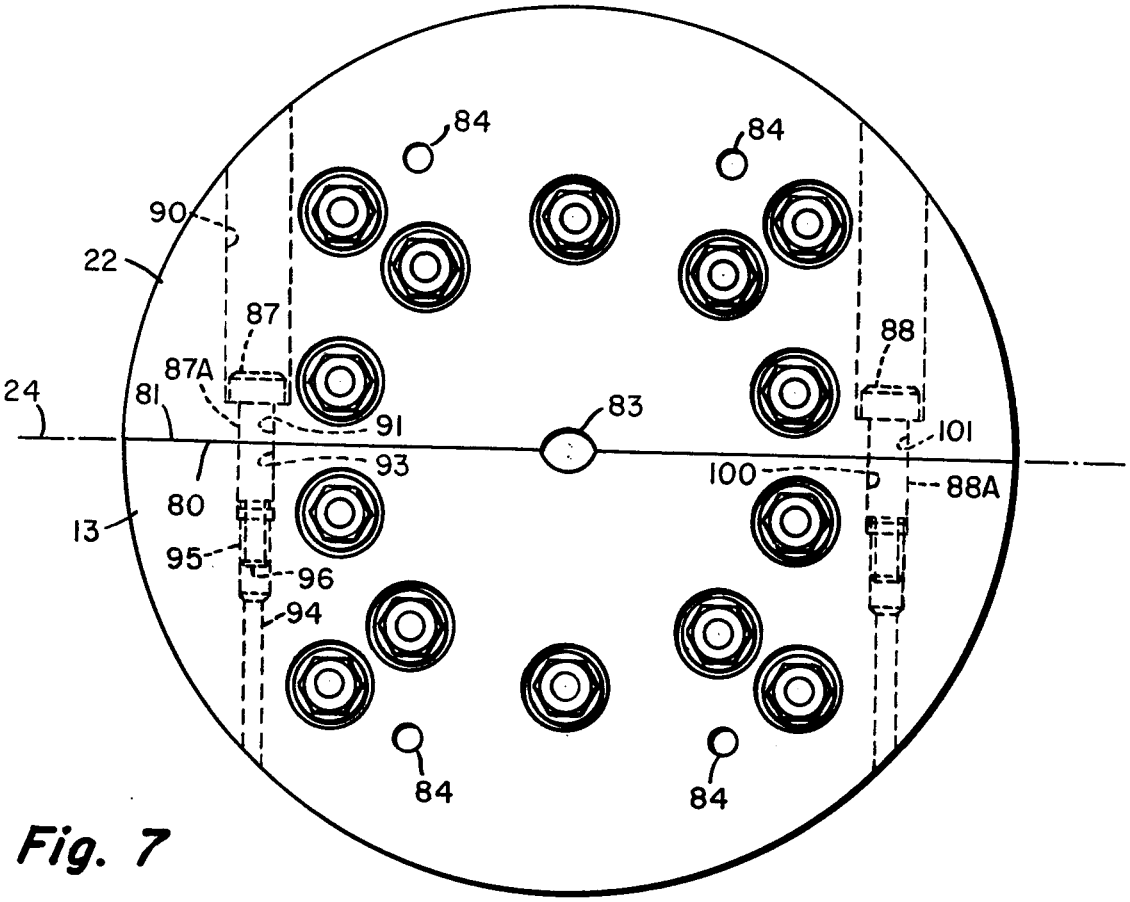
FIGS. 7 and 8 are end views of the assembled cylinder before and after final machining respectively.
Figure 8:
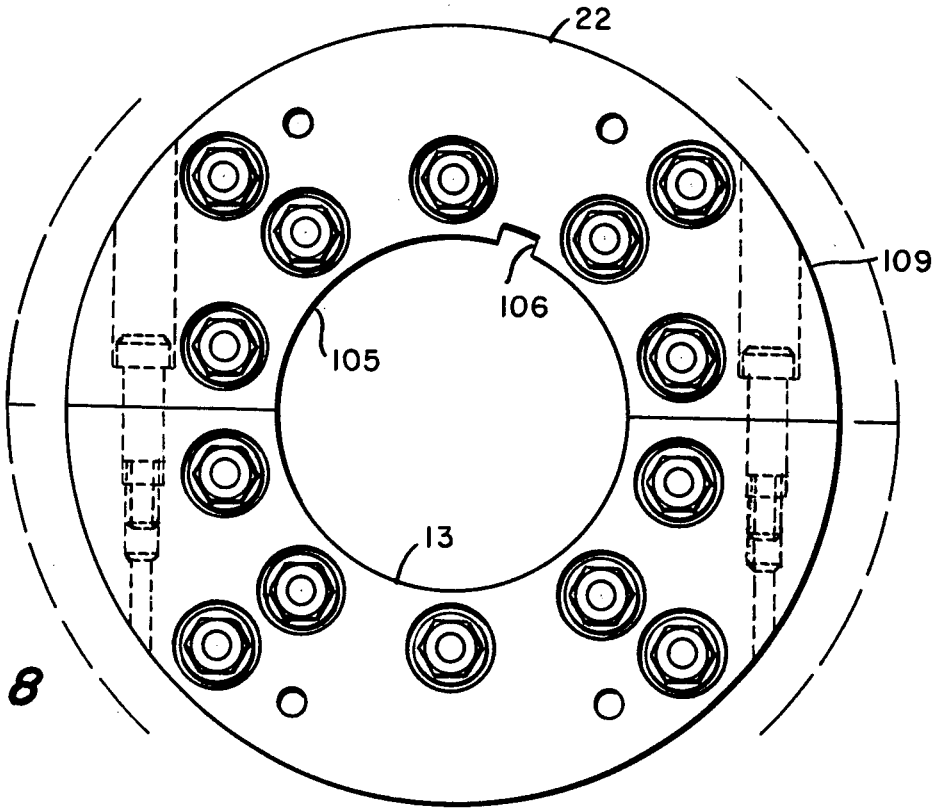

Referring now to FIGS. 7 and 8, as indicated above, the end plates 13, 22 may be formed from the same piece of stock by splitting along the line 24. Obviously, this removes some of the material from the abutting surfaces 80, 81 of the respective end plates. A central bore 83 may have been formed in the original plate, and locating apertures 84 may also be formed for subsequent machining operations.

The end plates are secured together by a pair of shoulder bolts 87, 88, each having a smooth shoulder portion designated 87A, 88A respectively. To receive the bolts, the end plate 22 has an enlarged bore 90 for receiving the head of the bolt 87 and a smaller bore 91 for receiving the shoulder 87A. A similar bore 93 is formed in the abutting surface at 80 of the end plate 13 to be aligned with the bore 91 of the end plate 22. The bores 91, 93 cooperate with the shoulder 87A of the bolt 87 to locate the end plates relative to each other. The end plate 13 is also bored at 94 and internally threaded at 95 to receive the threaded end portion 96 of the shoulder bolt 87. The bolt 88 is similarly used to locate and to fasten the end plates together, the shoulder portion 88A being located in aligned bores 100, 101 of the respective end plates 13, 22. The end plates 14 and 22A are similarly joined. After the abutting surfaces of the split shells are machined in a grinding machine, and the split shells are assembled together, an enlarged central bore 105 and keyway 106 are formed in the joined end plates for receiving a shaft containing a spline fitting into the keyway 106. The outer surface of the joined split shells is then machined to final outside diameter dimensions, as indicated at 109.

Persons skilled in the art will thus appreciate that the end plates for a given size cylinder may be formed by splitting two identical pieces of stock. Further, the end plates are all interchangeable except for the keyway and the bores for the shoulder bolts; hence, stocking requirements for end plates are greatly reduced. Further, the present invention obviates the need of machining a core or column member for receiving the laminations by virtue of using the core bars 16–20. As indicated, the core is fabricated by having the ends of the core bars snugly received in the associated end plates and secured by means of nuts, and by welding the core bars to the laminations, as well as by covering the core bars, inner edges of the laminations and welds with the epoxy layer 75 of FIG. 3.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

What is claimed is:

1. In a split-shell magnetic printing cylinder including first and second half cylinders each comprising first and second end plates; a plurality of laminations between said end plates and alternately forming pole pieces and spacers, each lamination having curved outer and inner edges; and permanent magnets in said spacers engaging adjacent pole pieces, the improvement comprising: a plurality of core bars extending between and secured to said end plates and arranged so that said bars engage the inner curved edges of said laminations when said laminations are assembled between said end plates; means for securing said core bars under tension to said end plates to compress said laminations together; weld joints between said core bars and the inner edges of said laminations; and means for securing said half cylinders together.

2. The apparatus of claim 1 wherein said core bars are rods having circular cross section, and wherein said end plates are bored to snugly receive said rods, the ends of said rods being threaded, said means for securing said core bars to said end plates comprising nuts received on the threaded ends of said core bars.

3. The apparatus of claim 1 further comprising a resin covering the inner edges of said laminations, said rods and said weld joints.

4. The apparatus of claim 2 wherein the axes of said core bars are substantially equidistant from and parallel to the axis of said cylinder.

5. The apparatus of claim 4 further comprising tie rods extending through said laminations and secured to said end plates under tension.

6. The apparatus of claim 1 wherein the end plates of adjacent half cylinders are butted together, each end plate defining a plurality of bores having their axes extend perpendicular to the axis of said cylinder and aligned with a bore in the abutting surface of an adjacent end plate, said means for securing said half cylinders together comprising shoulder bolts each having a shoulder portion received in the aligned bores of abutted end plates.

7. The apparatus of claim 1 characterized in that said end plates are interchangeable for the same diameter cylinder.

8. In a split shell magnetic printing cylinder having first and second half cylinders, each half cylinder including a plurality of laminations alternately forming pole pieces and spacers and each lamination having curved outer and inner edges with permanent magnets in said spacer engaging adjacent pole pieces, the improvement comprising: first and second interchangeable end plates for each split cylinder; a core extending between said end plates and including a plurality of core bars having their ends snugly received in said end plates; means for securing said core bars to said end plates under tension to thereby compress said laminations; a weld joint between each of said core bars and the inner edges of said laminations; and shoulder bolt means each having a shoulder portion extending into abutting end plates for securing said half cylinders together.

9. The apparatus of claim 8 further comprising a layer of epoxy for each half cylinder covering the exposed inner edges of said laminations and said weld joints, and at least partially covering said core bars.

10. The apparatus of claim 8 wherein said core bars are spaced at substantially equal angular increments about the axis of each half cylinder to permit access to the inner edges of said laminations for making said weld joints to thereby secure said laminations against movement.

* * * * *